US005181800A

United States Patent [19]

Stankus et al.

[11] Patent Number: 5,181,800

[45] Date of Patent: * Jan. 26, 1993

[54] MINE ROOF ANCHOR HAVING ADJUSTABLE RESIN RETAINING WASHER

[75] Inventors: John C. Stankus, Canonsburg; Eugene H. Stewart, Pittsburgh; Glen S. Grissinger, Hollidaysburg, all of Pa.

[73] Assignee: Jennmar Corporation, Pittsburgh, Pa.

[ * ] Notice: The portion of the term of this patent subsequent to Sep. 12, 2006 has been disclaimed.

[21] Appl. No.: 813,943

[22] Filed: Dec. 24, 1991

Related U.S. Application Data

[63] Continuation of Ser. No. 702,147, May 13, 1991, abandoned, which is a continuation of Ser. No. 389,620, Aug. 3, 1989, abandoned, which is a continuation of Ser. No. 229,699, Aug. 8, 1988, Pat. No. 4,865,489.

[51] Int. Cl.[5] ..... E21D 20/02

[52] U.S. Cl. ..... 405/259.6; 405/259.5; 411/82

[58] Field of Search ..... 405/259.1–259.6; 403/261, 265, 267, 268, 360; 248/125, 231.8; 411/82; 24/20 S

[56] References Cited

U.S. PATENT DOCUMENTS

| | | | |
|---|---|---|---|
| Re. 25,869 | 10/1965 | Schuermann et al. | 405/261 |
| 2,629,908 | 3/1953 | Keck | 24/20 S |
| 4,299,515 | 11/1981 | Yates et al. | 405/259 |
| 4,618,291 | 10/1986 | Wright | 405/261 |
| 4,865,489 | 9/1989 | Stankus et al. | 405/261 |
| 5,501,516 | 2/1985 | Kotulla et al. | 405/260 |

OTHER PUBLICATIONS

"Bethlehem Roof and Rock Bolts", Bethlehem Steel, Catalog 2366-A.

"Bethlehem Mine and Industrial Trackwork for Safe Hauling", Bethlehem Steel Catalog 2341.

*Primary Examiner*—Dennis L. Taylor
*Assistant Examiner*—John A. Ricci
*Attorney, Agent, or Firm*—Stanley J. Price, Jr.

[57] ABSTRACT

A roof anchor for supporting an underground mine roof or the like is provided. The roof anchor has an elongated shaft with a head formed at one end. The head supports a washer and a roof supporting plate that surrounds the mouth of a blind bore formed upwardly into the roof. A resin capsule is positioned within the blind bore above the roof anchor. The shaft of the roof anchor has an adjustably securable annular washer surrounding the shaft. The annular washer is fixed in a position so that when the resin capsule is ruptured to release the resin to bind the roof anchor within the bore hole, the resin completely fills the bore hole from the blind end of the bore to the rigid annular washer fixed to the shaft of the roof anchor. By making the position of the annular washer axially adjustable, the roof anchor may be utilized with varying amounts of resin as conditions at the mine site require and still cause the resin to be subjected to a compressive force within the bore hole in the space between the end of the bore hole and the annular washer.

24 Claims, 3 Drawing Sheets

MINE ROOF ANCHOR HAVING ADJUSTABLE RESIN RETAINING WASHER

CROSS REFERENCE TO RELATED APPLICATIONS

This application is a continuation of copending prior application Ser. No. 702,147 filed on May 13, 1991, entitled "MINE ROOF ANCHOR HAVING ADJUSTABLE RESIN RETAINING WASHER", now abandoned, a continuation of application Ser. No. 389,620 filed on Aug. 3, 1989, entitled "MINE ROOF ANCHOR HAVING ADJUSTABLE RESIN RETAINING WASHER", now abandoned, a continuation of application Ser. No. 229,699 filed on Aug. 8, 1988, entitled "MINE ROOF ANCHOR HAVING ADJUSTABLE RESIN RETAINING WASHER", now U.S. Pat. No. 4,865,489.

BACKGROUND OF THE INVENTION

1. Field of the Invention

This invention relates to an improved roof anchor which is at least partially retained in a rock formation by resin bonding material and which has an axially adjustable resin retaining washer that is positionable along the shaft of the roof anchor to retain the resin at the end of the roof anchor and to exert a compressive force on the resin before it sets.

2. Description of the Prior Art

It is well known in the art of mine roof support to tension roof anchors in bore holes drilled in the mine roof to reinforce the unsupported rock formation above the roof. Conventionally, a hole is bored through the roof into the rock formation. The end of the roof anchor is anchored in the rock formation by either engagement of an expansion shell on the end of the anchor with the rock formation or by adhesively bonding the anchor with a resin bonding material to the rock formation surrounding the bore hole or by using a combination of a mechanical expansion shell and resin bonding material. When resin bonding material is utilized, it penetrates the surrounding rock formation to adhesively unite the rock strata and to firmly hold the roof anchor in position within the bore hole. The resin mixture fills the annular area between the bore hole wall and the shaft of the roof anchor.

U.S. Pat. No. 4,419,805 and U.S. Pat. No. 4,413,930 are examples of mine roof anchors utilizing a combination of an expansion shell and a resin bonding material to retain the roof anchor within the rock strata. These patents disclose rigid resin retaining washers which are axially fixed to the shaft of the roof anchor and which may not be adjusted after the roof anchor leaves the manufacturing site and is delivered to the mine site.

U.S. Pat. No. 4,162,133 also shows a roof anchor which is retained within a rock strata by both a mechanical expansion anchor and resin bonding material. This patent discloses a rigid resin retaining washer that is supported on the shaft of the roof anchor by ears that are pinched into the shaft of the roof anchor by ears that are pinched into the shaft of the roof anchor in a fixed position. The rigid resin supporting washer of this patent is not axially adjustable since the position of the ears pinched into the shaft of the roof anchor will determine the position that the rigid washer assumes when the resin comes into contact with it.

We have found that by providing an axially adjustable rigid resin retaining washer we can accurately coordinate the annular area available for the resin to occupy with the amount of resin that is utilized in the roof anchor system so that when the roof anchor is installed, the upward thrust of the roof anchor will exert a hydraulic force on the resin bonding material to confine it within a restricted annular area at the end of the roof anchor and to cause the resin bonding material to be forcefully driven into the cracks and crevices on the inside wall of the bore hole and into the surrounding rock formation to more solidly lock the roof anchor within the rock formation.

SUMMARY OF THE INVENTION

In accordance with the present invention there is provided a roof anchor for supporting an underground mine roof or the like that includes an elongated shaft having first and second end portions. The shaft first end portion is secured within a blind bore hole formed in the roof by means that include resin bonding material that bonds the shaft first end portion to the inner wall of the bore hole. The shaft second end portion has means cooperating with it to bear against the mine roof around the mouth of the bore hole. An annular stop means is adjustably securable to the elongated shaft at any selected point along the shaft to prevent the resin bonding material from flowing from the shaft first end portion to beyond the stop means before the resin bonding material has set. The stop means is able to withstand the hydraulic pressure created when the elongated shaft penetrates the bonding material before the bonding material has set without the stop means moving longitudinally relative to the shaft.

Further, in accordance with the present invention, there is provided a roof anchor for supporting an underground mine roof or the like that has an elongated shaft having first and second end portions. The shaft first end portion is secured within a blind bore hole formed in the roof by a combination of resin bonding material and a mechanical expansion shell surrounding a tapered plug thread onto the shaft first end portion whereby the expansion shell is expanded to contact the inner wall of the blind bore hole. The resin bonding material is initially contained in an unmixed condition within a destructible capsule positioned within the bore hole. The capsule contains an adhesive resin material in a first compartment and a catalyst hardener material in a second compartment so that when the roof anchor is inserted into the bore hole, the capsule is fractured and the components of the two compartments are mixed together by rotation of the shaft and the expansion shell so that the resin bonding material is conditioned to secure elements of the roof anchor to the inner wall of the bore hole. The shaft second end portion has a bolt head formed on the extreme end that is arranged to contact a roof support plate that bears against the mine roof around the mouth of the bore hole so that the bolt head will force the support plate against the roof when the roof anchor is installed in the bore hole. An annular stop means is adjustably securable to the elongated shaft at any preselected point along the shaft between the mechanical expansion shell and the bolt head to prevent the resin bonding material from flowing down from the shaft first end portion to beyond the stop means before the resin bonding material has set. The stop means is able to withstand the hydraulic pressure created when the roof anchor fractures the destructible capsule without the stop means moving longitudinally relative to the shaft. The stop means is secured in a selected position on the shaft before the anchor is inserted into the bore hole so that the amount of resin bonding material utilized to secure the roof anchor to the bore hole will completely fill the space within the bore hole that is not filled by the roof anchor from the blind end of the bore hole to the stop means and so as to cause a pressure to be exerted on the resin bonding material within the bore hole before the resin bonding material sets.

Still further in accordance with the present invention, there is provided a method of supporting an underground mine roof or the like wherein a blind bore hole is formed upwardly into the roof. A resin bonding material contained in an unmixed condition within a destructible resin capsule is inserted into the blind hole. An adjustable annular stop means is secured onto a roof anchor that has an elongated shaft at a point on the shaft between the ends of the shaft selected to accommodate the size of the destructible resin capsule. The roof anchor is inserted into the blind bore hole to fracture the resin capsule. The resin is mixed within the bore hole. The resin is permitted to set with a bolt head that is formed on the roof anchor shaft supporting a roof support plate that surrounds the bore hole and abuts the mine roof. The annular stop means is positioned on the shaft at a point where the resin confined within the blind bore hole by the annular stop means completely fills the space within the blind bore not filled by the roof anchor and is forced into crevices in the inside wall of the blind bore hole.

Accordingly, a principal object of the present invention is to provide a method and apparatus for positioning a rigid annular stop means on a roof anchor shaft so that the stop means is adjustable to accommodate the amount of resin bonding material that will be utilized with the roof anchor due to changing conditions in anchorage strata that could conceivably require adjustment at the mine site and so that the stop means may be placed to exert a compressive force on the resin bonding material before it sets.

Another object of the present invention is to provide a roof anchor with a rigid adjustable resin retaining stop means that may be utilized with or without a mechanical expansion shell on the roof anchor.

Another object of the present invention is to provide a rigid adjustable annular stop means for the shaft of a roof anchor which may be utilized with a smooth shaft, a shaft made of steel concrete reinforcing bar, or a shaft having rough helical threads on the surface thereof.

These and other objects of the present invention will become apparent as this description proceeds in conjunction with the accompanying drawings and the appended claims.

DESCRIPTION OF THE PREFERRED EMBODIMENTS

Figure 2:
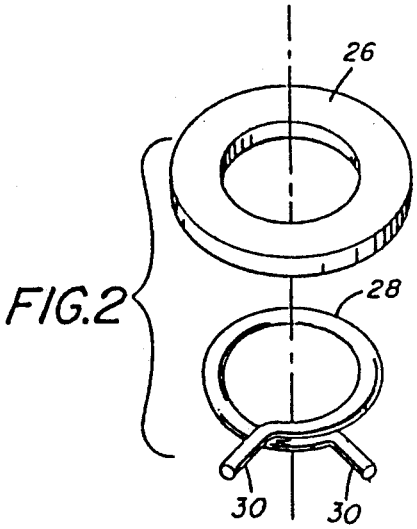
FIG. 2 is an exploded perspective view of the stop means of FIG. 1.
Figure 1:
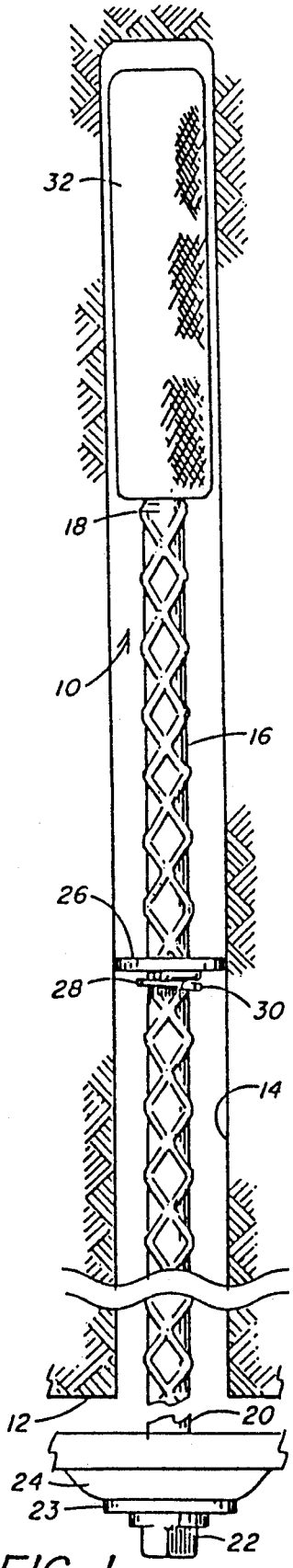
FIG. 1 is a side elevational view of a roof anchor utilizing an adjustable stop means of the present invention positioned within a bore hole in a mine roof.

Referring to the drawings and particularly to FIGS. 1 and 2, there is shown a mine roof anchor 10 that is utilized to support a mine roof 12. A bore hole 14 is formed upwardly into the mine roof 12 and the shaft 16 of roof anchor 10 is positioned within the bore hole 14. The shaft 16 has a first end portion 18 that is inserted into the bore hole 14 first and a second end portion 20 that is positioned near the mouth of the bore hole 14 at the mine roof 12. The shaft second end portion 20 has a bolt head 22 formed thereon. As seen in FIG. 1, the shaft 16 of roof anchor 10 is formed from steel concrete reinforcing the bar.

Immediately adjacent to bolt head 22 a washer 23 surrounds the shaft 16. Washer 23 bears against a roof support plate 24 that abuts the mine roof 12 when the roof anchor 10 is fixed in its final position. At a point between the shaft first end portion 18 and second end portion 20 a rigid annular washer 26 is held in place axially on the shaft 16 by a spring wire clamp 28. The washer 26 fits loosely over the shaft 16 and is of such an outer diameter that the outer periphery of washer 26 extends into close proximity with the interior wall of bore hole 14.

The spring wire clamp 28 is normally biased to a closed position so that when relaxed it securely clamps about the shaft 16 of roof anchor 10. The spring wire clamp 28 has ears 30 formed thereon so that the ears 30 can be biased toward each other thereby increasing the internal diameter of spring wire clamp 28 so that it may be moved from position to position axially along the shaft 16. Once the spring wire clamp 28 is in the desired position, the washer 26, which is between the first end portion 18 of shaft 16 and the spring wire clamp 28, is positioned against the spring wire clamp 28. When a force is exerted on the washer 26 axially toward the spring wire clamp 28 the spring wire clamp 28 forcefully grips the shaft 16 and prevents axial movement of the washer 26 and the spring wire clamp 28 relative to shaft 16.

Before the roof anchor 10 is positioned within bore hole 14, a resin capsule 32 is placed within bore hole 14 above the anchor 10. The resin capsule 32 is a conventional capsule that contains the resin bonding material utilized to bond the shaft 16 within the bore hole 14. The capsule 32 contains the resin bonding material in an unmixed condition within the destructible capsule 32. An adhesive resin material is contained in one compartment within the capsule 32 and a catalyst hardener material is contained within a second compartment. When the destructible capsule 32 is fractured, the contents within the two separate compartments come together and are mixed by rotation of the shaft 16 of roof anchor 10.

The resin capsule 32 may be obtained in varying sizes containing varying amounts of resin. Similarly, more than one resin capsule may be utilized with one roof anchor depending upon the amount of resin desired to anchor the particular roof anchor 10. The non-homogenous nature of the roof conditions underground, the type of rock formation forming the roof, and the positioning of the roof anchors will all have some bearing upon the amount of resin to be utilized and consequently the amount of adjustability needed on the resin retaining washer.

With the arrangement as shown in FIGS. 1 and 2, the rigid annular washer 26 and the spring wire clamp 28 are positioned at a point on the shaft 16 of roof anchor 10 so that the amount of resin in capsule 32 will completely fill the annular space from the end of the bore hole 14 to the annular washer 26 that is not filled by the shaft 16 of anchor 10. With such an arrangement, when the roof anchor 10 is forced up into the bore hole 14 to fracture capsule 32, the rigid annular washer 26 will put pressure on the fluid resin to force it into cracks and crevices within the interior wall of bore hole 14 to strengthen the anchorage of the roof anchor 10 after the resin sets.

The spring wire clamp 28 must be of such size and spring force as to forcefully clamp the spring wire clamp 28 around the outer surface of shaft 16. When the roof anchor 10 is forced upwardly to fracture capsule 32, large hydraulic forces will tend to force washer 26 and spring wire clamp 28 downwardly as viewed in FIG. 1. The strength of spring wire clamp 28 and washer 26 must be sufficient to withstand these large hydraulic forces.

Figure 3:
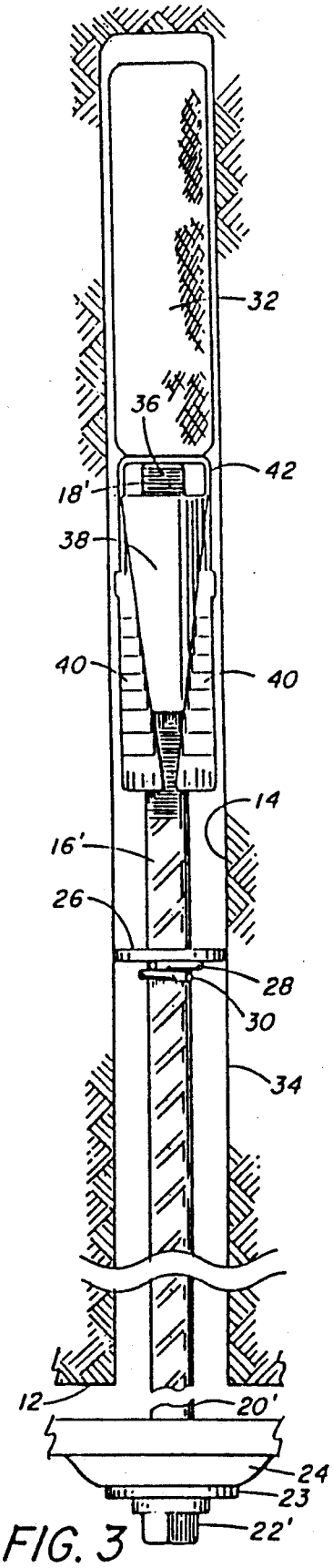
FIG. 3 is a side elevational view similar to FIG. 1 showing the stop means of the present invention utilized on a different type of roof anchor.

Referring now to FIG. 3, there is shown another embodiment of a roof anchor 34 having a shaft 16 that has a first end portion 18 and a second end portion 20. The second end portion 20 has a bolt head 22 formed thereon. The shaft 16 of roof anchor 34 is formed with coarse helical thread-like configurations on the outside of the shaft. The first end portion 18 of shaft 16 is threaded as at 36 to receive the tapered plug 38 that cooperates with leaves 40 in a conventional fashion to form a mechanical expansion shell. Leaves 40 are attached to each other by a bail 42 that extends over the end of shaft 16.

Rigid annular washer 26 and spring wire clamp 28, which are identical to those previously described in connection with the embodiment of FIG. 1, are positioned on shaft 16 and may be adjustably secured at any point between the bottom of the leaves 40 and the second end portion 20 of shaft 16. When the roof anchor 34 is positioned within the blind bore hole 14, a resin capsule 32 as previously described is placed into the bore hole before the roof anchor 34 is inserted. Again, the position of washer 26 and spring wire clamp 28 is adjusted so that the amount of resin in capsule 32 will fill the space in bore hole 14 between the end of the bore hole and the rigid annular washer 26 that is not filled by the shaft 16 and the mechanical expansion shell consisting of tapered plug 38 and leaves 40.

Figure 4:
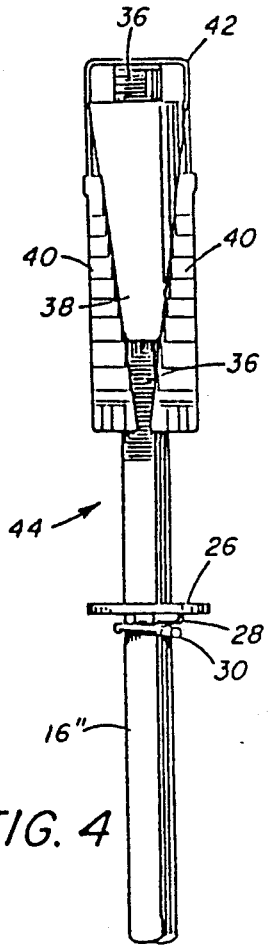
FIG. 4 is a side elevational view of the stop means of the present invention being utilized on a roof anchor having a shaft with a smooth outer surface.

Referring to FIG. 4, there is shown another roof anchor 44 which has a shaft 16. The shaft 16 is formed with a smooth external cylindrical surface. In all other respects roof anchor 44 is the same as roof anchor 34 and like reference numerals refer to like parts on both roof anchors 34 and 44.

Figure 5:
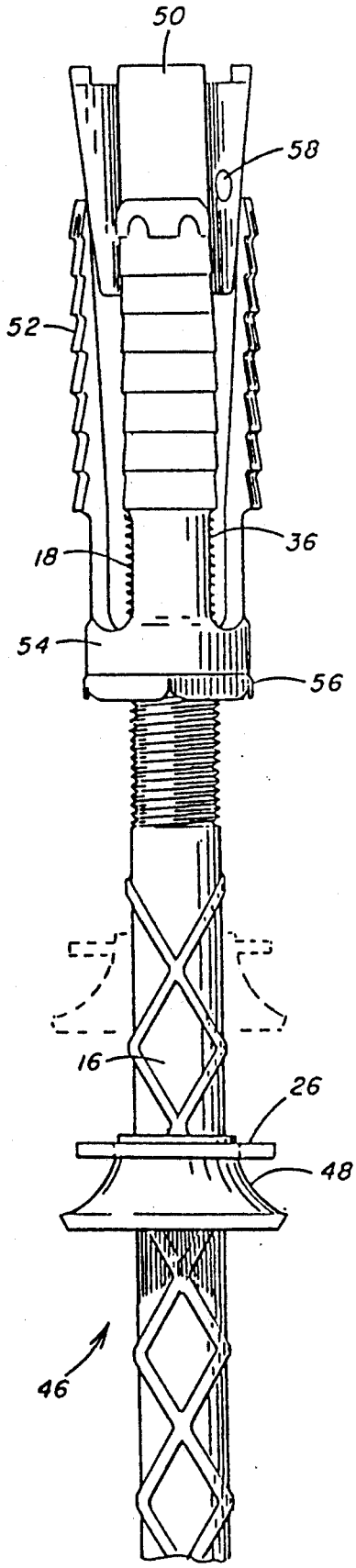
FIG. 5 is a side elevational view of a roof anchor utilizing a second embodiment of the stop means of the present invention.

Referring now to FIGS. 5–10, inclusive, there is shown another form of roof anchor 46. Roof anchor 46 has a shaft 16 formed from a steel concrete reinforcing bar. In FIGS. 5–10, reference numerals which refer to parts that are identical to items already described in connection with FIGS. 1–4 have been given identical reference numerals. As shown in FIG. 5, the first end portion 18 of shaft 16 has been threaded at 36 to receive a tapered plug 50 that cooperates with leaves 52 to make up a mechanical expansion shell. Leaves 52 are formed integrally with a ring 54 and are upstanding from ring 54. The ring 54 and leaves 52 are supported on the shaft 16 by a pal nut or jam nut 56 that is threaded onto threads 36. The wedge 50 has a shear pin 58 that extends through it to delay expansion of the mechanical expansion shell until resin has created resistance to the rotation of the expansion shell as described in U.S. Pat. No. 4,419,805 assigned to the assignee herein.

Figure 6:
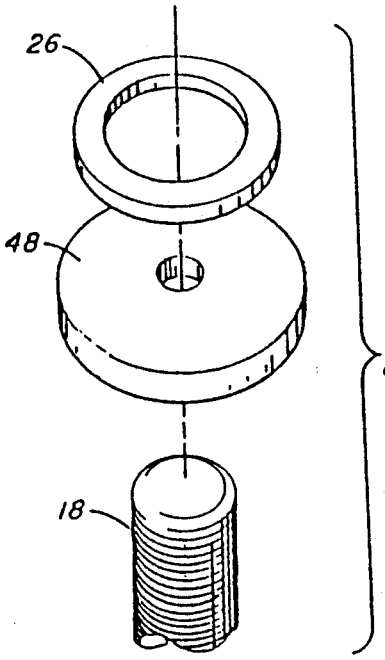
FIG. 6 is an exploded perspective view of the stop means shown in FIG. 5.
Figure 7:
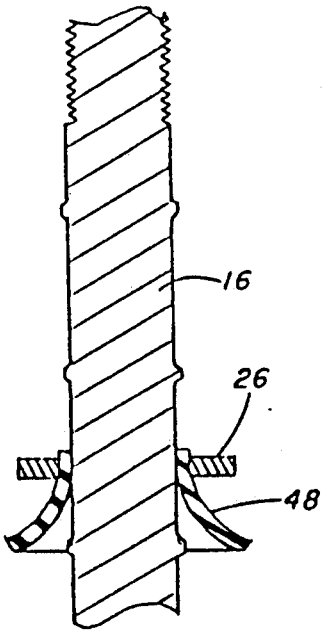
FIG. 7 is a longitudinally section of a portion of the roof anchor shown in FIG. 5.

In the embodiments shown in FIGS. 5–10 the rigid annular washer 26 cooperates with a rubber-like washer 48 to fix the annular stop means on the shaft 16 at any desired axially position. As shown in FIG. 6, the rubber-like washer 48 in the relaxed position has a small center hole which must be forced over the shaft 16 of roof anchor 46. When washer 48 is forced over shaft 16, it deforms to the shape as shown in FIG. 7. The loose-fitting rigid annular washer 26 is then moved down over the shaft 16 and over a portion of the rubber-like washer 48 so that when an axial force is exerted on washer 26 that tends to move it toward washer 48, a portion of washer 48 is trapped between the inner portion of washer 26 and shaft 16 to force the trapped portion of washer 48 firmly against shaft 16.

Figure 8:
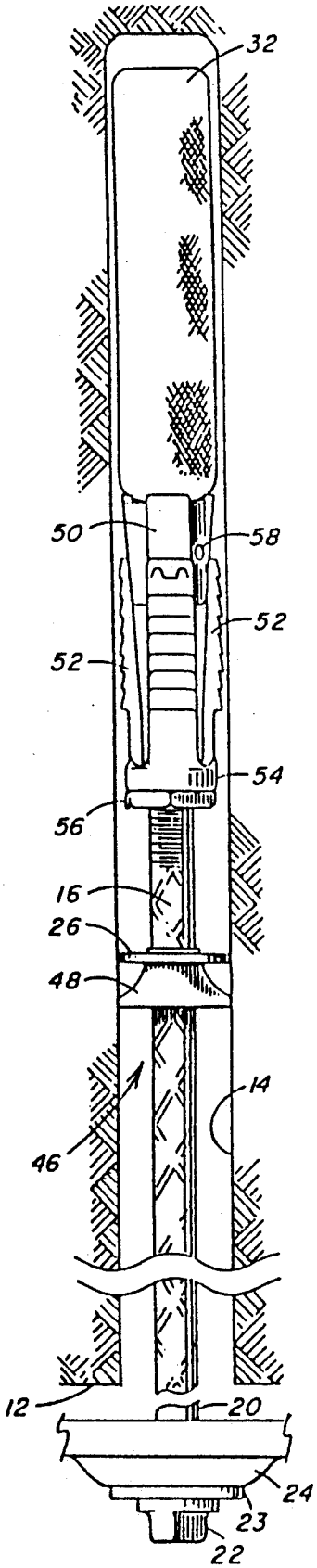
FIG. 8 is a side elevational view of the roof anchor of FIG. 5 positioned within the bore hole of a mine roof before the resin capsule is punctured.
Figure 9:
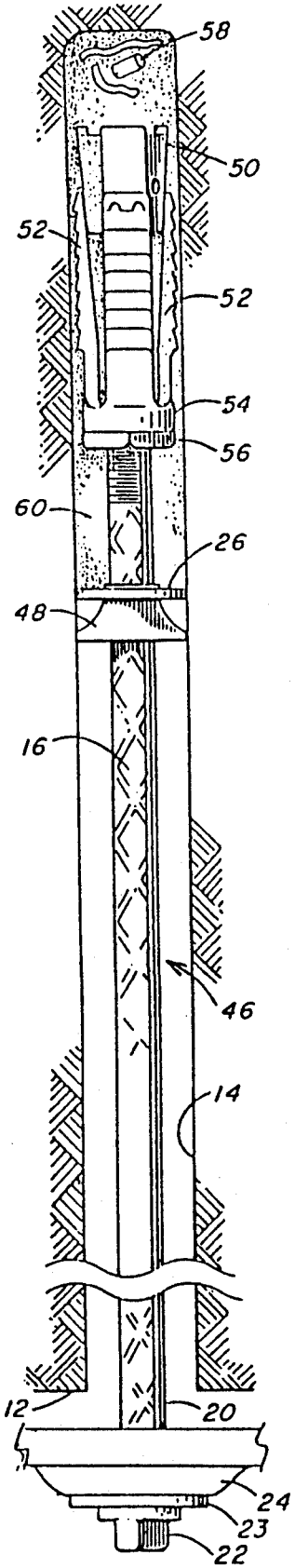
FIG. 9 is an elevational view similar to FIG. 8 showing the roof anchor after the resin capsule has been fractured but before the mechanical expansion shell has been expanded.
Figure 10:
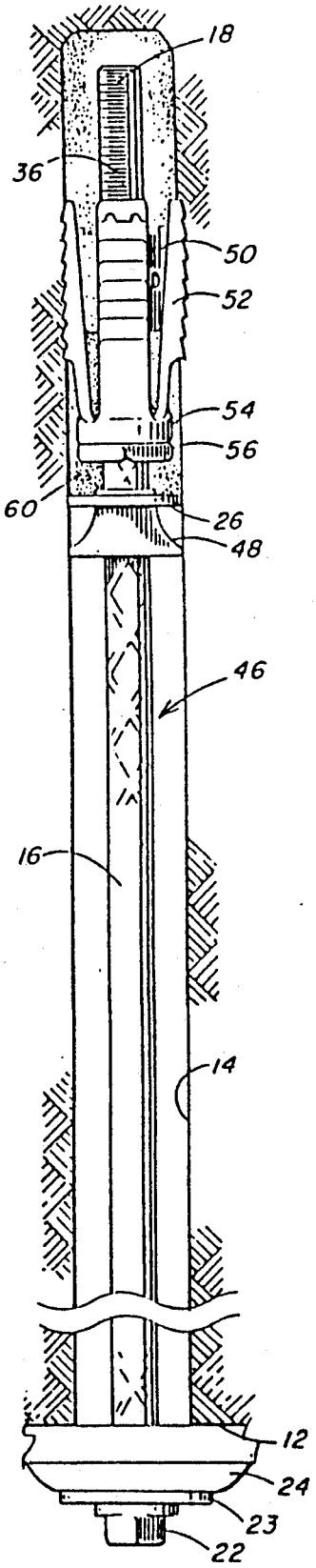
FIG. 10 is an elevational view similar to FIGS. 8 and 9 showing the roof anchor with the expansion shell assembly expanded and the roof anchor under tension.

Referring to FIGS. 8, 9 and 10, it will be seen that the roof anchor 46 is placed into blind bore hole 14 below the conventional resin capsule 32. As in the earlier described embodiments, the rigid annular washer 26 and rubber-like washer 48 are actually positioned on shaft 16 so that the resin within capsule 32 will completely fill the portion of the bore hole 14 from the end of the bore hole to washer 26 that is not filled by the shaft 16 and the mechanical expansion shell. FIG. 8 shows the roof anchor 46 positioned within the bore hole before the destructible capsule 32 has been ruptured. The head 22 of shaft 16 is spaced well away from roof 12 and the washer 23 and roof support plate 24 rest against bolt head 22.

As shown in FIG. 9, the roof anchor 46 has been forced upwardly to rupture capsule 32. Rotation of the shaft 16 and mechanical expansion shell as a unit have caused mixing of the resin 60 which has been released from the capsule 32 and the resin has caused sufficient resistance to rotation of the leaves 52 so as to cause shearing of the shear pin 58 that permits the shaft 16 to be threaded up into wedge 50. It will be noted that the free resin 60 from the capsule 32 now completely fills the blind bore hole 14 between its end and washer 26.

FIG. 10 shows the roof anchor 46 with the expansion shell completely expanded so that the leaves 52 are in contact with the bore hole 14 and shaft 16 has been threaded up into wedge 50 to draw the roof support plate 24 into contact with roof 12 by washer 23 and bolt head 22 being carried upwardly by shaft 16. The resin 60 has been trapped between washer 26 and the end of the bore hole 14 and some of the resin has been forced into the cracks and crevices in the surface of bore hole 14.

We have found that by utilizing the rigid washer 26 and adjusting its position along the shaft 16 of roof anchors, great strength can be provided to the anchorage with relatively small amounts of resin bonding material. As an example, in a bore hole having a diameter of 1⅜ inches, and utilizing a roof anchor of the type shown in FIGS. 5–10, with a resin capsule only 6 inches long, the roof anchor withstood a pulling force of 26,000 pounds without losing anchorage. This outstanding result is achieved because the resin is trapped between the end of the blind bore hole and the washer 26 and put under pressure so that the resin fills the cracks and crevices within the bore hole and strongly anchors itself to the interior of the blind bore hole.

According to the provisions of the Patent Statutes, we have explained the principal, preferred construction, and mode of operation of our invention and have illustrated and described what we now consider to represent its best embodiments. However, it should be understood that, within the scope of the appended claims, the invention may be practiced otherwise than as specifically illustrated and described.

We claim:

1. A roof anchor for supporting an underground mine roof or the like comprising:

an elongated shaft having first and second end portions operable to be positioned in a bore hole in a mine roof having an open end portion at said mine roof and a blind closed end portion in the strata above said mine roof;

said shaft first end portion being arranged to be inserted and secured within said bore hole formed in said roof by a preselected volume of a resin bonding material inserted in said bore hole in capsule form above said shaft front end portion, at least a portion of said resin bonding material arranged to be mixed in said bore hole by rotation of said shaft to set said resin and bond said shaft first end portion to the inner wall of said bore hole;

said shaft second end portion having means cooperating therewith operable to bear against said mine roof at said open end portion of said bore hole;

annular stop means positioned on said elongated shaft for exerting a compressive force on said preselected volume of said resin bonding material positioned thereabove in said bore hole, said annular stop means movable to a preselected position along the length of said elongated shaft, positioning means engaged to said elongated shaft below said annular stop means for locating said annular stop means at a preselected location along the length of said shaft so that upon insertion of said shaft first end portion in said bore hole said annular stop means is axially fixed on said shaft to exert pressure on said resin bonding material before said resin bonding material has been mixed by said shaft and set, and said annular stop means arranged to maintain a compressive force on said resin bonding material while said bonding material is mixed and further maintains said compressive force on said preselected volume of said resin bonding material while said resin bonding material sets and after said bonding material has set.

2. The roof anchor of claim 1 wherein said resin bonding material is initially contained in an unmixed condition within a destructible capsule positioned within said bore hole, said capsule containing an adhesive resin material in a first compartment and a catalyst hardener material in a second compartment so that when said roof anchor shaft is inserted into said bore hole, said capsule is fractured and the contents of said first and second compartments are mixed by rotation of said shaft so that said resin bonding material hardens and secures said shaft first end portion to the inner wall of said bore hole.

3. The roof anchor of claim 1 wherein said annular stop means comprises a rigid annular washer loosely surrounding said shaft and having an outer edge extending into close proximity to the inner wall of said bore hole, and said positioning means engaged to said elongated shaft below said washer and arranged to support said washer so that said washer maintains a compressive force on said resin bonding material.

4. The roof anchor of claim 3 in which said positioning means is frictionally engaged to said elongated shaft.

5. The roof anchor of claim 1 wherein said annular stop means comprises a rigid annular washer loosely surrounding said shaft and having an outer edge extending into close proximity to the inner wall of said bore hole, and a circular spring wire clamp having actuating ears whereby said spring wire clamp is spring loaded to be compressed around said roof anchor shaft at a point closer to said shaft second end portion than said rigid annular washer, said clamp being arranged to be released from said shaft by forcing said ears toward each other.

6. The roof anchor of claim 1 wherein said annular stop means comprises a rigid annular washer loosely surrounding said shaft and having an outer edge portion extending into close proximity to the inner wall of said bore hole, and a flexible, rubber-like washer snugly surrounding said shaft at a point closer to said shaft second end portion than said rigid annular washer whereby when said rubber-like washer is positioned at a selected position on said shaft and said rigid annular washer abuts said rubber-like washer and is forced toward said shaft second end portion, a portion of said rubberlike washer extending between said rigid annular washer and said shaft to hold said rubber-like washer against said shaft and prevent axial movement of said rubber-like washer relative to said shaft.

7. The roof anchor of claim 1 in which said roof anchor includes an expansion shell assembly including an expansion shell engaging a tapered plug threaded onto said shaft first end portion, said expansion shell assembly arranged to secure said roof anchor shaft to said bore hole inner wall, provide a tension on said roof anchor shaft and further compress said resin before it hardens and sets.

8. The roof anchor of claim 1 wherein said annular stop means is adjustably positioned at a preselected position on said shaft before said anchor is inserted into said bore hole so that the preselected volume of said resin bonding material utilized to secure said roof anchor to said bore hole inner wall fills the space within said bore hole that is not occupied by said roof anchor from the blind end of said bore hole to said stop means, said stop means arranged to compress said resin bonding material and cause a pressure to be exerted on said resin bonding material within said bore hole before said resin bonding material is mixed and sets.

9. A roof anchor for supporting an underground mine roof or the like comprising:

an elongated shaft having first and second end portions operable to be positioned in a bore hole in a mine roof having an open end portion at said mine roof and a blind closed end portion in the strata above said mine roof;

said shaft first end portion being arranged to be inserted and secured within said bore hole formed in said roof by a combination of a preselected volume of resin bonding material inserted in said bore hole in capsule form above said shaft front end portion, and a mechanical expansion shell assembly including an expansion shell surrounding a tapered plug threaded onto said shaft first end portion whereby said expansion shell is expanded to contact the inner wall of said blind bore hole;

said resin bonding material arranged to bond said shaft end portion and said expansion shell assembly to the inner wall of said bore hole;

said preselected volume of resin bonding material being initially contained in an unmixed condition within a destructible capsule positioned within said bore hole, said capsule containing an adhesive resin material in a first compartment and a catalyst hardener material in a second compartment so that when said shaft and said mechanical expansion shell assembly is inserted into said bore hole, said capsule is fractured and at least a portion of the contents of said first and second compartments are mixed together by rotation of said shaft and said mechanical expansion shell assembly whereby said resin bonding material is conditioned to secure elements of said roof anchor to the inner wall of said bore hole;

said shaft second end portion having a bolt head formed on the extreme end thereof, said bolt head arranged to contact a roof support plate that bears against said mine roof at said open end portion of said bore hole whereby said bolt head will force said support plate against said roof when said anchor is installed in said bore hole;

annular stop means engaged to said elongated shaft at a preselected location along said shaft between said mechanical expansion shell and said bolt head for preventing said resin bonding material from flowing from said shaft first end portion to a location downwardly in said bolt hole beyond said stop means before said resin bonding material has set;

adjustable means positioned on said shaft for axially fixing said annular stop means at a preselected location to exert a compressive force on said resin positioned thereabove in said bore hole before said resin bonding material has been mixed by said shaft and said mechanical expansion shell and to withstand the hydraulic pressure created when said shaft and expansion shell fractures said destructible capsule;

said adjustable means being movable to a preselected position on said elongated shaft below said mechanical expansion shell so that the location of said annular stop means on said elongated shaft is fixed before said anchor is inserted into said bore hole so that the preselected amount of said resin bonding material utilized to secure said roof anchor to said bore hole will completely fill the space within said bore hole that is not filled by said roof anchor and mechanical expansion shell assembly from the blind end of said bore hole to said stop means and cause a compressive force to be exerted on said resin bonding material within said bore hole to compress said resin bonding material before said resin bonding material hardens and sets and further compress at least a portion of said resin as said expansion shell expands and maintains said compressive force on said resin bonding material until said resin bonding material has hardened and set.

10. The roof anchor of claim 9 wherein said annular stop means comprises a rigid annular washer loosely surrounding said shaft and having an outer edge extending into close proximity to the inner wall of said bore hole, said adjustable means engaged to said elongated shaft below said washer and arranged to support said washer so that said washer maintains a compressive force on said resin bonding material.

11. The roof anchor of claim 10 in which said adjustable means is frictionally engaged to said elongated shaft.

12. The roof anchor of claim 9 wherein said annular stop means comprises a rigid annular washer loosely surrounding said shaft and having an outer edge portion extending into close proximity to the inner wall of said bore hole, and a circular spring wire clamp having actuating ears whereby said spring wire clamp is spring loaded to be compressed around said roof anchor shaft at a point closer to said shaft second end portion than said rigid annular washer, said clamp arranged to be released by forcing said ears toward each other, said rigid annular washer abutting said spring wire clamp when said anchor is inserted into said bore hole.

13. The roof anchor of claim 9 wherein said annular stop means comprises a rigid annular washer loosely surrounding said shaft and having an edge portion extending into close proximity to the inner wall of said bore hole, and a flexible, rubber-like washer snugly surrounding said shaft at a point closer to said shaft second end portion than said rigid annular washer so that when said rubber-like washer is positioned at a selected position on said shaft and said rigid annular washer abuts said rubber-like washer said rubber-like washer is forced toward said shaft second end portion and a portion of said rubber-like washer is trapped between said rigid annular washer and said shaft to forcefully hold said rubber-like washer against said shaft to prevent axial movement of said rubber-like washer relative to said shaft.

14. The roof anchor of claim 9 wherein said elongated shaft is formed from a steel concrete reinforcing bar.

15. The roof anchor of claim 9 wherein said elongated shaft is formed from a smooth cylindrical steel rod.

16. The roof anchor of claim 9 wherein said elongated shaft is formed from a steel bar having coarse helical threads formed on the outside surface thereof.

17. A method of supporting an underground mine roof or the like comprising:

forming a blind bore hole upwardly in a mine roof, said blind bore hole having a wall and a closed blind end portion in the strata above the mine roof;

inserting into said blind bore hole a preselected volume of a resin bonding material contained in a substantially unmixed condition within a destructible resin capsule with components of said resin bonding material being confined within separate compartments of said capsule;

providing a roof anchor which includes a shaft with first and second end portions, an annular stop means on said shaft intermediate said first and second end portions and a bolt head on said second end portion;

adjusting the position of said annular stop means along the length of said roof anchor shaft to a preselected location on said shaft between said first and second end portions to provide a volume of space between said stop means on said shaft and said closed blind end portion of said bore hole that is not occupied by said roof anchor and is less than the volume of said resin bonding material in said capsule;

inserting said roof anchor first end portion in said blind bore hole and moving said first end portion upwardly in said blind bore hole toward said closed blind end portion, fracturing said resin capsule and said separate compartments therein with said roof anchor shaft first end portion while urging said roof anchor upwardly in said bore hole to trap said resin in a substantially unmixed condition between said bore hole blind end portion and said annular stop means to put pressure on said resin before said resin hardens;

rotating said roof anchor to mix said components of said resin bonding material within said bore hole while compressing said resin between said bore hole blind end portion and said annular stop means; and maintaining said resin compressed while said resin hardens and sets.

18. The method of claim 17 where said annular stop means is secured to said roof anchor shaft at said preselected location by sliding a circular spring wire clamp along said shaft to said preselected location with the clamp being forced open while said wire clamp is being positioned, thereafter permitting said clamp to relax at said preselected location whereby the spring loading of the clamp will cause it to grip said shaft and sliding a loose-fitting rigid annular washer on said shaft into contact with said clamp with said washer being closer to said shaft first end portion than said spring wire clamp.

19. The method of claim 17 wherein said annular stop means is secured to said roof anchor shaft by sliding a tight fitting rubber-like washer along said shaft to the desired position, thereafter sliding a loose-fitting rigid annular washer on said shaft into abutting contact with said rubber-like washer whereby a portion of said rubber-like washer contacting said shaft is trapped by said loose-fitting washer to prevent further axial movement of said washers relative to said shaft; said rigid annular washer being closer to said shaft first end portion than said rubber-like washer.

20. The method of claim 17 wherein at least a portion of said mixing of said resin is accomplished by rotating said roof anchor shaft.

21. The method of claim 17 that includes the step of positioning a mechanical expansion shell assembly on said shaft first end portion prior to insertion of said roof anchor in said bore hole so that upon expansion said expansion shell assembly further compresses at least a portion of said resin before it hardens.

22. A roof anchor for supporting an underground mine roof or the like comprising:

an elongated shaft having first and second end portions, said shaft operable to be positioned in a bore hole in a mine roof, said bore hole having an open end portion at said mine roof and a blind closed end portion in the strata above said mine roof;

said shaft first end portion having an expansion shell assembly including an expansion shell positioned thereon and engaging a tapered plug threaded onto said shaft first end portion;

said shaft first end portion with said expansion shell assembly positioned thereon arranged to be inserted into said bore hole formed in said roof;

a preselected volume of a resin bonding material positioned in said bore hole in capsule form above said shaft front end portion, said resin bonding material arranged to bond said shaft first end portion to the inner wall of said bore hole;

said shaft second end portion having means cooperating therewith operable to bear against said mine roof at said open end portion and an enlarged head portion arranged to rotate said shaft in said bore hole;

annular stop means positioned on said elongated shaft for exerting a compressive force on said preselected volume of said resin bonding material positioned thereabove in said bore hole, said annular stop means movable to a preselected position along the length of said elongated shaft, positioning means engaged to said elongated shaft below said annular stop means for locating said annular stop means at a preselected location along the length of said shaft so that upon insertion of said shaft first end portion in said bore hole said annular stop means is axially fixed on said shaft to exert pressure on said resin bonding material before said resin bonding material has set and maintains said compressive force on said resin bonding material, said expansion shell assembly, upon rotation of said shaft in said bore hole, arranged to exert a further compressive force on at least a portion of said resin bonding material before said resin bonding material has set and expand said expansion shell to engage the inner wall of said bore hole and provide a tension on said roof anchor shaft; and said compressive force and said further compressive force maintained on said resin bonding material until said resin bonding material has set.

23. A roof anchor for supporitng an underground mine roof or the like comprising:

an elongated shaft having first and second end portions operable to be positioned in a bore hole in a mine roof having an open end portion at said mine roof and a blind closed end portion in the strata above said mine roof;

said shaft first end portion being arranged to be inserted and secured within said bore hole formed in said roof by a combination of a preselected volume of resin bonding material inserted in said bore hole in capsule form above said shaft front end, and a mechanical expansion shell assembly including an expansin shell surrounding a tapered plug threaded onto said shaft first end portion whereby said expansion shell is expanded to contact the inner wall of said blind bore hole;

said resin bonding material arranged to bond said shaft end portion and said expansion shell assembly to the inner wall of said bore hole;

said preselected volume of resin bonding material being initially contained in an unmixed condition within a destructible capsule positioned within said bore hole, said capsule containing an adhesive resin material in a first compartment and a catalyst hardener material in a second compartment so that when said roof anchor is inserted into said bore hole, said capsule is fractured and the contents of said first and second compartments are mixed together by rotation of said roof anchor whereby said resin bonding material is conditioned to secure elements of said roof anchor to the inner wall of said bore hole;

said shaft second end portion having a bolt head formed on the extreme end thereof, said bolt head constructed and arranged to contact a roof support plate that bears against said mine roof around the mouth of said bore hole whereby said bolt head will force said support plate against said roof when said anchor is installed in said bore hole;

annular stop means engaged to said elongated shaft at a preselected location along said shaft between said mechanical expansion shell and said bolt head for preventing said resin bonding material from flowing from said shaft first end portion to a location downwardly in said bolt hole beyond said stop means before said resin bonding material has set;

adjustable means positioned on said shaft for axially fixing said annular stop means at a preselected location to exert a compressive force on said resin positioned thereabove in said bore hole and to withstand the hydraulic pressure created when said roof anchor fractures said destructible capsule;

said stop means being secured in a position on said shaft before said anchor is inserted into said bore hole so that the preselected amount of said resin bonding material utilized to secure said roof anchor to said bore hole completely fills the space within said bore hole that is not filled by said roof anchor from the blind end of said bore hole to said stop means and cause a compressive force to be exerted on said resin bonding material within said bore hole to compress said resin bonding material before said resin bonding material hardens and sets; and said expansion shell assembly arranged upon rotation of said shaft to expand said expansion shell into contact with the inner wall of said blind bore hole and further compress said resin bonding material before said resin bonding hardens and sets.

24. A method of supporting an underground mine roof or the like comprising:

forming a blind bore hole upwardly in a mine roof, said blind bore hole having a wall and a closed blind end portion in the strata above the mine roof;

inserting into said blind bore hole a preselected volume of a resin bonding material contained in an unmixed condition within a destructible resin capsule with components of said resin bonding material being confined within separate compartments of said capsule;

providing a roof anchor which includes a shaft with first and second end portions, an annular stop means on said shaft intermediate said first and second end portions, a bolt head on said second end portion, and a mechanical expansion shell assembly having an expansion shell surrounding a tapered plug threaded onto said shaft first end portion;

securing said annular stop means on said roof anchor shaft at a preselected location on said shaft between said first and second end portions to provide a volume of space between said stop means on said shaft and said closed blind end portion of said bore hole that is not occupied by said roof anchor and expansion shell assembly and is less than the volume of said resin bonding material in said capsule;

inserting said roof anchor first end portion in said blind bore hole and moving said first end portion upwardly in said blind bore hole toward said closed blind end portion, fracturing said resin capsule and said separate compartments therein with said roof anchor shaft first end portion while urging said roof anchor upwardly in said bore hole to trap said resin by said annular stop means to put pressure on said resin before said resin hardens;

rotating said roof anchor to mix said components of said resin bonding material within said bore hole while compressing said resin and expanding said expansion shell into contact with the inner wall of said blind bore hole to further compress said resin; and permitting said resin to set while being compressed by said annular stop means and said expansion shell assembly with said bolt head formed on the second end portion of said roof anchor shaft supporting a roof support plate surrounding said bore hole and abutting said mine roof.

* * * * *